US010081769B2

(12) United States Patent
Bernar et al.

(10) Patent No.: US 10,081,769 B2
(45) Date of Patent: Sep. 25, 2018

(54) PARTIAL UPGRADING SYSTEM AND METHOD FOR HEAVY HYDROCARBONS

(71) Applicant: Husky Oil Operations Limited, Calgary (CA)

(72) Inventors: Rodger Francesco Bernar, Calgary (CA); Lei Jia, Calgary (CA)

(73) Assignee: Husky Oil Operations Limited, Calgary, AB (CA)

( * ) Notice: Subject to any disclaimer, the term of this patent is extended or adjusted under 35 U.S.C. 154(b) by 204 days.

(21) Appl. No.: 14/950,264

(22) Filed: Nov. 24, 2015

(65) Prior Publication Data

US 2016/0145505 A1 May 26, 2016

Related U.S. Application Data

(60) Provisional application No. 62/083,406, filed on Nov. 24, 2014.

(51) Int. Cl.
*C10G 47/34* (2006.01)

(52) U.S. Cl.
CPC ..... *C10G 47/34* (2013.01)

(58) Field of Classification Search
CPC ..... C10G 47/34
See application file for complete search history.

(56) References Cited

U.S. PATENT DOCUMENTS 2,772,213 A 11/1956 Fischer
2,953,513 A 9/1960 Langer, Jr.
4,284,139 A 8/1981 Sweany
4,292,168 A 9/1981 Derbyshire et al.
4,430,197 A 2/1984 Poynor et al.
(Continued)

FOREIGN PATENT DOCUMENTS

CA 1122914 * 5/1982
CA 1122914 A 5/1982
(Continued)

OTHER PUBLICATIONS

Aitchison, D.W., et al., "The liquefaction of an Alberta sub-bituminous coals with hydrogenated bitumen," Fuel, 1990, 69:97-102, 6 pgs.

(Continued)

*Primary Examiner* — Randy Boyer
*Assistant Examiner* — Juan C Valencia
(74) *Attorney, Agent, or Firm* — Frost Brown Todd LLC

(57) ABSTRACT

Systems and methods for partially upgrading a produced heavy hydrocarbon resource at the production site (at the pad or a central processing facility) using indirect hydrogen addition, comprising a blender for blending the hydrocarbon with a hydrogen donator and a reactor for elevating the mixture to a temperature sufficient to hydrogenate the hydrocarbon to an API level required for pipeline specifications. The partially upgraded hydrocarbon can then be transported by pipeline to a refinery for further processing. The presence of catalysts and on-site hydrogen production equipment conventionally required for upgrading is eliminated. Further, the need for diluent which is conventionally used to enable pipeline ability of produced heavy hydrocarbon is reduced or eliminated, thus reducing the diluent freight cost and the required pipeline volume.

54 Claims, 3 Drawing Sheets

(56) References Cited

U.S. PATENT DOCUMENTS

| | | | | |
|---|---|---|---|---|
| 4,454,023 | A * | 6/1984 | Lutz | C10G 67/049 208/106 |
| 4,465,587 | A | 8/1984 | Garg et al. | |
| 4,569,753 | A * | 2/1986 | Busch | C10G 11/18 208/127 |
| 4,615,791 | A * | 10/1986 | Choi | C10G 47/34 208/106 |
| 4,640,762 | A | 2/1987 | Woods et al. | |
| 4,814,065 | A | 3/1989 | Rankel | |
| 4,857,168 | A | 8/1989 | Kubo et al. | |
| 5,105,480 | A | 4/1992 | Howell et al. | |
| 5,332,489 | A | 7/1994 | Veluswamy | |
| 5,395,511 | A | 3/1995 | Kubo et al. | |
| 5,443,715 | A | 8/1995 | Grenoble et al. | |
| 7,594,990 | B2 | 9/2009 | Satchell, Jr. | |
| 7,651,605 | B2 | 1/2010 | Sahara et al. | |
| 7,943,035 | B2 | 5/2011 | Chornet et al. | |
| 8,105,480 | B2 | 1/2012 | Chornet et al. | |
| 8,871,081 | B2 | 10/2014 | Chornet et al. | |
| 9,745,525 | B2 | 8/2017 | Chornet et al. | |
| 2011/0240517 | A1 | 10/2011 | Chornet et al. | |
| 2012/0005949 | A1* | 1/2012 | Stevens | C10G 1/002 44/307 |
| 2016/0145505 | A1 | 5/2016 | Bernar et al. | |

FOREIGN PATENT DOCUMENTS

| | | | |
|---|---|---|---|
| CA | 1191471 | A | 8/1985 |
| CA | 2611251 | A1 | 9/2008 |
| CA | 2814773 | A1 | 9/2008 |
| CA | 2617985 | A1 | 12/2008 |
| CA | 2617985 | C | 12/2012 |
| CA | 2611251 | C | 1/2014 |
| CA | 2814773 | C | 8/2014 |
| CA | 285887 | A1 | 2/2015 |
| CN | 101663378 | A | 3/2010 |
| CN | 102504862 | A | 6/2012 |
| CN | 101663378 | B | 7/2014 |
| CN | 105658769 | A | 6/2016 |
| EP | 0 216 448 | A1 | 4/1987 |
| EP | 1 785 468 | A1 | 5/2007 |
| EP | 2118240 | | 11/2009 |
| EP | 3046994 | | 7/2016 |
| WO | WO 2008/106765 | A1 | 9/2008 |
| WO | WO 2009/000062 | A1 | 12/2008 |
| WO | WO 2009/000062 | A8 | 4/2009 |
| WO | WO 2015/021546 | A1 | 2/2015 |

OTHER PUBLICATIONS

Clark, P.D., et al., "Combustion of Bitumen/Bitumen Coke for Power Production with Complete Emission Control and Sulfur Production," PowerPoint, ASRL Chalk Talk, Fairmont Palliser Hotel, Calgary, Alberta, Canada, Jan. 22, 2009, 14 pgs.

Clark, P.D., et al., "Emerging Technologies for Bitumen Upgrading and Utilization," ASRL Review, Sep.Oct. 2008, Sulphur 318:40-42, 4 pgs.

Clark, P.D., et al., "Energy Efficient and Green Technology for Conversion of Oil Sands Bitumen to Synthetic Crude Oil," PowerPoint, ASRL Chalk Talk, Fairmont Palliser Hotel, Calgary, Alberta, Canada, Jan. 22, 2009, 12 pgs.

Clark, P.D., et al., "Estimation of the Energy Efficiency and Emission Control for the ASRL Bitumen Upgrading Process in Comparison to Convention Coking Based Processes," PowerPoint, ASRL Chalk Talk, Fairmont Palliser Hotel, Calgary, Alberta, Canada, Jan. 22, 2009, 16 pgs.

Clark, P.D., "Oil Sands Bitumen: Opportunites and challenges," ASRL Review, Sep.-Oct. 2006, Sulphur 306:40-42, 4 pgs.

Clark, P.D., et al., "Primary Bitumen and Oil Residua Upgrading: An Alternative Strategy for the Northern Gateway Pipeline and Relevance to Marine Bunker Fuel Desulphurization," PowerPoint, ASRL Chalk Talk presentation, Fairmont Palliser Hotel, Calgary, AB, Canada, Jan. 23, 2013, 7 pgs.

Clark, P.D., et al., "Primary Upgrading of Oil Sands Bitumen: New technology for pipeline transportation and replacement of conventional coking," Core Research Program Item 15, 2007-2008, PowerPoint, ASRL Chalk Talk and Poster Session, Fairmont Palliser Hotel, Calgary, Alberta, Jan. 24, 2008, 15 pgs.

Clark, P.D., et al., "Transportation of Alberta Bitumen Without Added Diluent: Production of Enhanced Value Crude Oil by Low Severity, Non-Coking Upgrading of Bitumen," PowerPoint, Petroleum Technology Alliance of Canada, Jun. 3, 2014, 16 pgs.

Clark, P.D., et al., "Transportation of Alberta Bitumen Without Added Diluent: Production of Enhanced Value Crude Oil by Low Severity, Non-Coking Upgrading of Bitumen," ASRL Quarterly Bulletin, Jan.-Mar. 2014, 168(4):1-18, 18 pgs.

Clark, P.D., et al., "Upgrading of Alberta bitumen for worldwide transportation—Impact on sulfur production," Sulphur 2014 International Conference & Exhibition, Paris, Nov. 3-6, 2014, 12 pgs.

Clark, P.D., et al., "Primary Upgrading of Oil Sands Bitumen for Pipeline Transportation," Core Research Program Item 11, 2006-2007, PowerPoint, ASRL Chalk Talk, Calgary, Alberta, Jun. 19, 2007, 16 pages.

* cited by examiner

PARTIAL UPGRADING SYSTEM AND METHOD FOR HEAVY HYDROCARBONS

CROSS-REFERENCE TO RELATED APPLICATIONS

This application claims the benefit of and priority to U.S. Provisional Application Ser. No. 62/083,406 filed Nov. 24, 2014, of same title, in its entirety for all purposes.

FIELD OF THE INVENTION

The present invention relates to systems and methods for processing heavy hydrocarbon deposits such as bitumen, and specifically to systems and methods for upgrading such deposits.

BACKGROUND OF THE INVENTION

It is well known in the field of heavy hydrocarbon production to upgrade the produced hydrocarbon from a hydrogen-deficient state to an upgraded product having greater commercial value. This full upgrading is commonly achieved by fractional distillation and hydroprocessing to produce saleable products like synthetic crude oil.

One primary category of upgrading is hydrogen addition, in which molecular hydrogen is reacted with the heavy hydrocarbon to add hydrogen to the heavy hydrocarbon's molecular structure and convert it to a higher value product. Three forms of hydrogen addition are commonly practiced in the Canadian heavy hydrocarbon industry, namely hydroconversion, hydrocracking and hydrotreating, all of which employ catalysts to drive the necessary conversion reactions.

However, the construction and operation of full upgrading facilities at the hydrocarbon production sites they service is well known to be extremely expensive, and would generally produce a product that is over-qualified to be shipped by pipeline. The conventional alternative has been to blend the heavy hydrocarbon at the production site with a refinery-sourced diluent such as a lighter hydrocarbon, which decreases the viscosity and increases the API of the product to a level at which it can be pipelined to a refinery for additional processing. By using diluent to reduce product viscosity/density and enable pipeline transportation, this commonly employed solution generates a continuous fluid flow loop between the production site and the refinery, with the refinery sending diluent to the production site for blending with the heavy hydrocarbon, and the production site sending the blended product back to the refinery for processing, with the diluent commonly being recycled and fed back into the process.

While the benefits of this conventional solution are obvious, it is also known that the use of diluent introduces certain disadvantages. For example, diluent is used in significant volumes, resulting in high freight costs for shipping the diluent. Because the diluent is piped to the refinery along with the heavy hydrocarbon as part of the blended product there is a necessary increase in the required pipeline volume and thus the costs involved. Also, the cost of diluent itself can be dissuasive. While on-site full upgrading would potentially provide a solution to these disadvantages by eliminating the need for diluent altogether, this would require the significant expense of a catalyst supply and in some cases an on-site hydrogen molecule production facility such as a steam methane reformer. In traditional on-site full upgrading processes, coke or asphaltenes can also be rejected on site, which can waste hydrocarbons and potentially create site disposal issues. This alternative thus manifests further disadvantages.

What is needed, therefore, is a means to prepare produced heavy hydrocarbon for transport to a refinery for the processing necessary to generate saleable products for the marketplace, but a means that represents a costs savings over the conventional solutions.

SUMMARY OF THE INVENTION

The present invention therefore seeks to provide systems and methods for partially upgrading produced heavy hydrocarbon resources such as bitumen at the pad or a central processing facility to a level required to make the product pipelineable, without the need for diluent, catalysts or on-site hydrogen production.

According to a broad aspect of the present invention there is provided a system and method for partially upgrading a produced heavy hydrocarbon, comprising:

a first source for supplying the heavy hydrocarbon;

a second source for supplying a hydrogen donator;

means for blending the heavy hydrocarbon and the hydrogen donator to form a mixture; and means for heating the mixture to a temperature necessary to liberate hydrogen molecules from the hydrogen donator and allow the hydrogen molecules to bond with the heavy hydrocarbon, resulting in a partially hydrogenated heavy hydrocarbon.

The system and method should also incorporate means for quickly cooling the upgraded product to avoid further cracking with undesirable coke, gas and olefins/di-olefins formation.

The heavy hydrocarbon can be any hydrocarbon that is too viscous to be pipelined, including for one non-limiting example bitumen. The hydrogen donator can be material prepared by any material that has the ability to take up hydrogen in a hydrocracking zone and to readily release it to a hydrogen-deficient heavy hydrocarbon under thermal conditions in the absence of a catalyst, including for one non-limiting example aromatic-naphthenic materials like tetralin (with or without substituent). The aromatic-naphthenic molecules can be produced through partial hydrogenation of the poly-aromatic molecules like naphthalene, anthracene, etc. Synthetic crude oil or its certain fractions like kerosene (177° C.-249° C.), diesel (249° C.-343° C.) and gas oil (343° C.-524° C.) can be the said hydrogen donator source.

The means for blending the heavy hydrocarbon and the hydrogen donator can be any blending apparatus appropriate to the type and volume of materials being processed, for one non-limiting example a surge drum. The means for heating the mixture can be any heater or liquid-phase reactor-type vessel, for one non-limiting example a convectional heater, and including without limitation a pressure vessel, which is configured to elevate the hydrogen donator temperature sufficiently to liberate the hydrogen molecules and allow the uptake of such hydrogen molecules by the heavy hydrocarbon.

The degree of required hydrocracking will vary with pipeline specifications. For example, in Canada it is known to have pipeline specifications of a minimum API gravity of 19° and a maximum viscosity of 350 cSt at 7° C. The temperature required to produce a partially upgraded heavy hydrocarbon of such API gravity and viscosity will vary depending on the original heavy hydrocarbon and the type of hydrogen donator employed for the conversion reaction, and such will at least partially determine the equipment specifications and operating parameters for the partial upgrading process.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Exemplary embodiments of the present invention will now be described with reference to the accompanying drawings.

DETAILED DESCRIPTION OF EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise forms of any exemplary embodiment. Accordingly, the description and drawings are to be regarded in an illustrative, rather than a restrictive, sense.

Three distinct embodiments are presented below, illustrating the principles of the present invention. As stated above, the goal of the invention is not to fully upgrade the produced hydrocarbon, but to only partially upgrade at the pad or a central processing facility so that it reaches pipelineability specifications. By achieving pipeline specifications the heavy hydrocarbon can be transported to a refinery for full processing, thus eliminating cost and complexity while generating numerous significant advantages.

Figure 1:
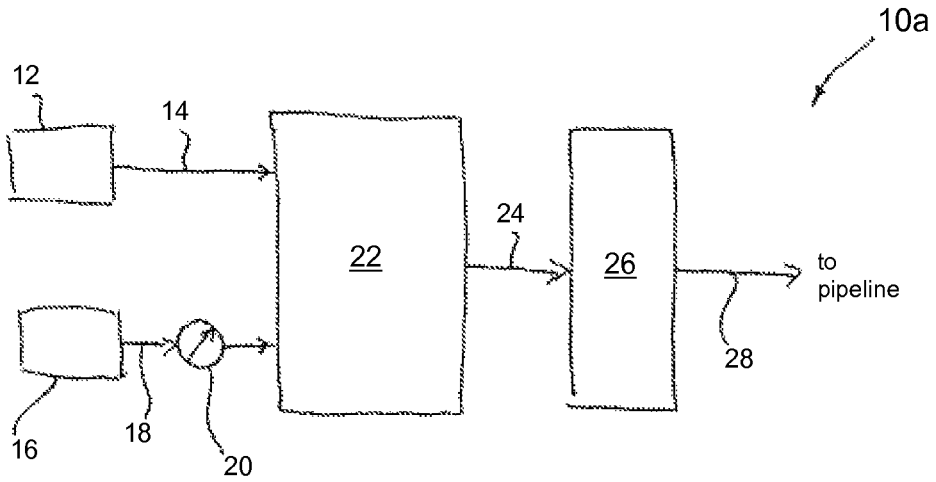
FIG. 1 is a simplified schematic view of a first embodiment of a system according to the present invention.

Turning to FIG. 1, a system 10*a* is illustrated. The system 10*a* has two illustrated inputs, namely a hydrogen donator source 12 and bitumen source 16. The hydrogen donator will be illustrated herein as tetralin, but it can in practice be any material prepared from a material that has the ability to take up hydrogen in a hydrocracking zone (for example in a refinery) and to readily release it to a hydrogen-deficient heavy hydrocarbon under thermal conditions in the absence of a catalyst. The hydrogen donator can be aromatic-naphthenic molecules produced through partial hydrogenation of the poly-aromatic molecules like naphthalene and anthracene, etc. Synthetic crude oil or its certain fractions like kerosene (177° C.-249° C.), diesel (249° C.-343° C.) and gas oil (343° C.-524° C.) can be the said hydrogen donator source. The heavy hydrocarbon selected for this illustrative example is bitumen, but any heavy hydrocarbon not meeting pipeline specifications could be considered for processing using the systems and methods of the present invention.

The hydrogen donator source 12 is a stream containing a hydrogen donator (like tetralin) that has had hydrogen added to it at a remote refinery through hydrogenation or partial hydrogenation, the partially hydrogenated product then piped from the refinery to the production site. Tetralin is an intermediate from hydrogenating methanol, and is one exemplary material known to have the necessary hydrogen retention and donation functionality required for the present invention. The hydrogen donator source 12 feeds the tetralin by means of a feed line 14 to a blender 22.

The bitumen source 16 provides bitumen to the blender 22 by means of a feed line 18. In a non-limiting example, the bitumen source 16 can comprise 30 to 70% vacuum residue (at or above 524 degrees C.), and can comprise (but is not limited to) Athabasca bitumen, Cold Lake heavy oil and other appropriate feedstock with an API gravity below 15 and viscosities greater than 30,000 cP. As bitumen is too viscous to flow or be pumped through the feed line 18, the feed line 18 is preferably provided with a pre-heater 20 to reduce the viscosity and allow the bitumen to be pumped into the blender. The degree of heating will obviously be relatively small, but will depend on the viscosity of the bitumen, the feed line 18 size and the desired feed velocity. The pre-heater 20 is preferably a liquid-liquid heat exchanger. Either or both of the bitumen and the hydrogen donator can be pre-heated, or even heated in the blender 22.

In one exemplary embodiment, the blender 22 would have an operating temperature of 25 to 500 degrees C., an operating pressure of 100 to 3500 psi, and a residence time of 1 minute to 5 hours, although this is only one exemplary embodiment. While the specifications of the blender could vary widely, as would be recognized by those skilled in the art, the blender should mix the bitumen and hydrogen donator well. It is known to be difficult to blend bitumen with diluents, and the blending of bitumen with the hydrogen donator could similarly require equipment capable of thorough mixing. The blender could, for example, be a surge drum, although those skilled in the art will readily be able to determine alternative equipment capable of achieving the desired mixture, based at least in part on the nature and volume of the feedstock. Also, it will be clear to those skilled in the art that while a single blender 22 is illustrated, this is for the sake of illustrative simplicity only and the blending could occur through a series of stages that would be known or obvious to those skilled in the art.

As will be clear to those skilled in the art, various blend ratios are possible depending on the specific materials being blended, and in one non-limiting example the bitumen can be up to 95% of the mixture and the hydrogen donator up to 30% of the mixture. Once the blender is operated to thoroughly blend the bitumen and the hydrogen donator, the mixture is pumped through a feed line 24 to a reactor 26. The reactor 26 can again take many different forms depending on the feedstock, but in one exemplary embodiment it is a conventional heater. The reactor 26 should be selected so as to heat the mixture evenly and quickly without the production of so-called "hot spots". The reactor 26 should be a continuous or semi-batch reactor rather than a batch-type reactor. The reactor 26 functions to raise the temperature of the mixture to a level necessary to cause the release of hydrogen from the hydrogen donator, which level will be situation-specific and dependent on the pressure environment and determinable by the skilled person, thus allowing the bitumen to take up that released hydrogen into its own molecular structure. The bitumen is thereby partially upgraded, but the required degree of partial upgrading will depend on the pipeline specifications. Clearly, then, the equipment specifications and operating parameters necessary to produce the necessary degree of partial upgrading will depend at least in part on the composition of the mixture, the feed velocity and numerous other considerations known to those skilled in the art. In one exemplary embodiment, the reactor 26 would have an operating temperature of 300 to 500 degrees C., an operating pressure of 100 to 3500 psi, and a residence time of 15 seconds to 2 hours, although this is only one exemplary embodiment. The resulting product would have a lower viscosity and lower density compared with a simple mixing of the bitumen and the hydrogen donator.

The reactor 26 can be powered by gas, for example in the form of a gas-circulating reactor, but other means could be employed. Where the reactor 26 is gas-powered, it is also possible that gas produced by the reactor 26 could be recycled back to power the reactor 26.

In the reactor 26, the conversion of the bitumen to a lower-viscosity product through partial upgrading occurs due to the presence of the hydrogen donator. The reaction between tetralin (as one exemplary type of hydrogen donator) and the bitumen is illustrated below as an example. R• and R'• free radicals are formed through cracking of hydrocarbons. Then tetralin (and its partially hydrogenated derivative) donate hydrogen to the free radicals. The reactions are thermally favourable, since the formed double bonds or aromatic rings on tetralin (and its partially hydrogenated derivative) stabilized the molecule due to a conjunction effect with the adjacent aromatic rings. Overall, tetralin facilitates the hydrocracking reaction of the heavy hydrocarbon.

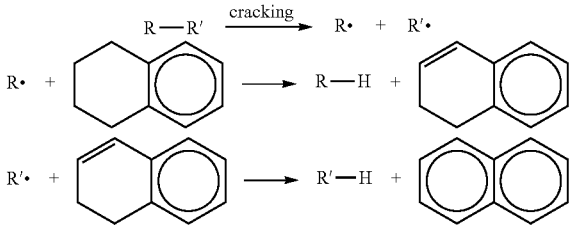

This reaction is known in the art as indirect hydrogen addition, where hydrogen is introduced to the bitumen through a carrier or donator. In conventional hydrocracking, direct hydrogen addition occurs which involves an on-site hydrogen molecule generator such as a steam methane reformer, where the generated molecules are introduced directly to the bitumen rather than through a carrier or donator.

In one exemplary method according to the present invention, the reactor 26 would be operated to achieve a mixture temperature of 350-450° C. (preferably 390-410° C.) at pressure of 100-3500 psi (preferably 700-1500 psi), with the ratio of the hydrogen donator in the mixture at 5-50% by volume (preferably 10-30%). These parameters may not be appropriate for all feedstocks or all pipelines, and are presented as illustrative only.

As the reactor 26 has functioned to enable the hydrocracking reaction, and the bitumen has been partially upgraded to meet pipeline specifications, there is no longer any need for blending with diluent. The hydrogen donator should be selected such that it can be piped with the partially upgraded bitumen to the refinery. The partially upgraded bitumen can be transported to the pipeline by an output line 28, and then by pipeline to the refinery for further processing.

The mixture produced by the reactor 26 would be at an elevated temperature, and thus would need to be cooled down to avoid over-cracking with formation of undesirable coke, gas and olefins/di-olefins. This could be achieved by any number of conventional means, such as for example a heat exchange system, and the means and the extent of cooling would be determinable within the ability of the skilled person. Preferably but not necessarily, the cooling means would reduce the temperature below 350 degrees C. while operating at 100 to 3500 psi, which may require a residence time of 1 second to 2 hours depending on the specific means employed.

Figure 2:
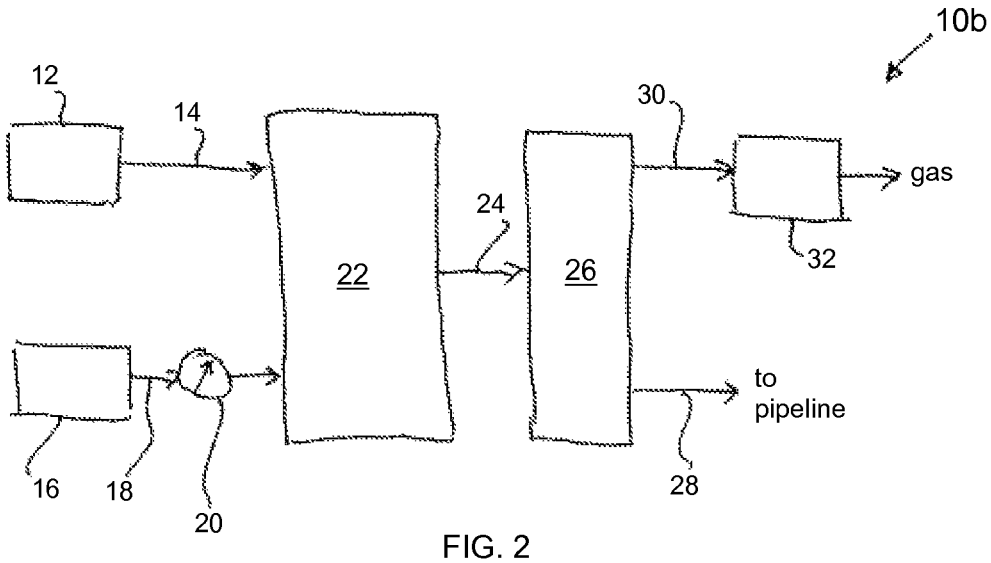
FIG. 2 is a simplified schematic view of a second embodiment of a system according to the present invention.

Turning now to FIG. 2, a further illustrative embodiment is presented. In this embodiment, a system 10*b* comprises the elements described above but also incorporates gas treatment. Specifically, the reactor 26 produces two streams—a hot mixture comprising partially upgraded bitumen to be sent to the pipeline, and a gas stream. The gas stream is sent via an output line 30 to a sulphur recovery unit 32, or SRU. The SRU 32 can be of any conventional design that is appropriate to the context, and could be easily selected by one skilled in the art.

Figure 3:
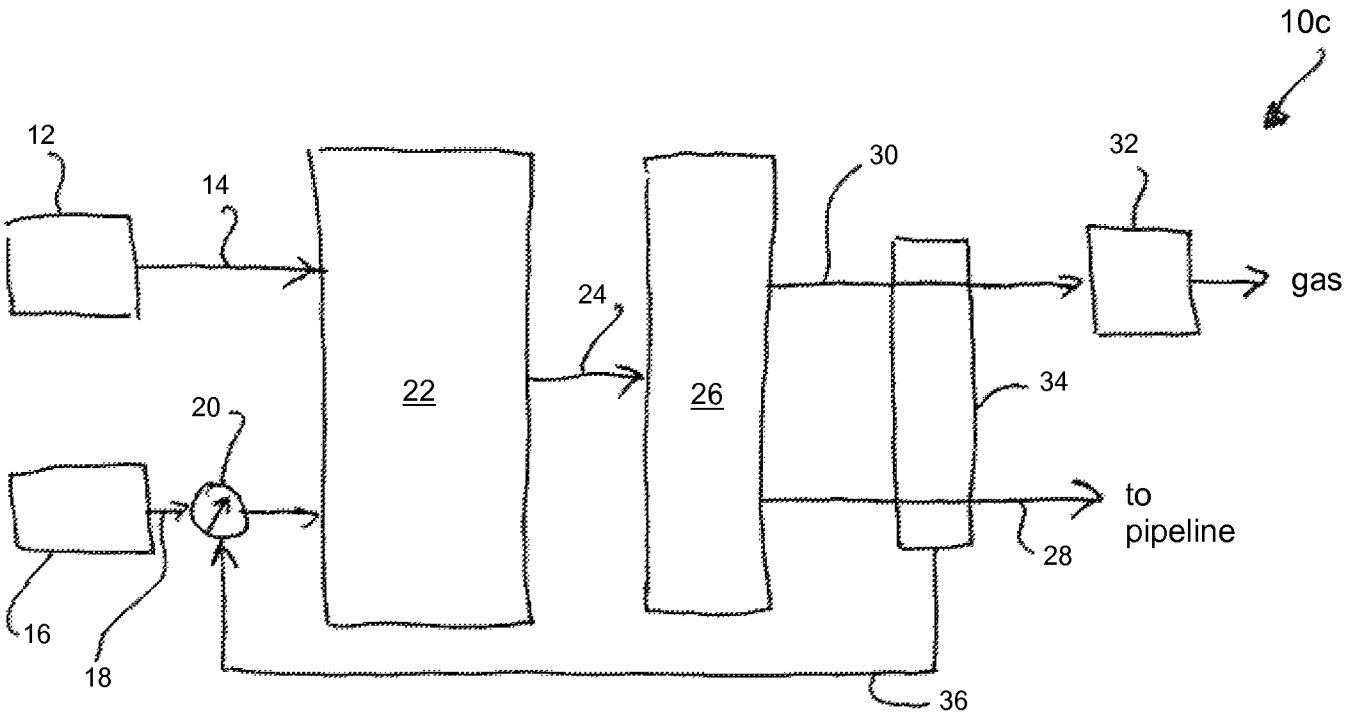
FIG. 3 is a simplified schematic view of a third embodiment of a system according to the present invention.

Turning now to FIG. 3, a yet further illustrative embodiment is presented. As was stated above, the reactor 26 produces a hot product, and that product should be—or in some contexts potentially must be—cooled before introduction to the pipeline. In the illustrated system 10*c*, the gas output line 30 and the mixture output line 28 both pass through a heat capture/exchange unit 34, which could be a conventional heat exchange apparatus as selected by one skilled in the art to suit the particular application. The heat captured by the unit 34 would reduce the temperature of the output lines 28, 30. The captured heat could then be transferred by conventional means through heat transfer line 36 to the bitumen pre-heater 20.

Figure 4:
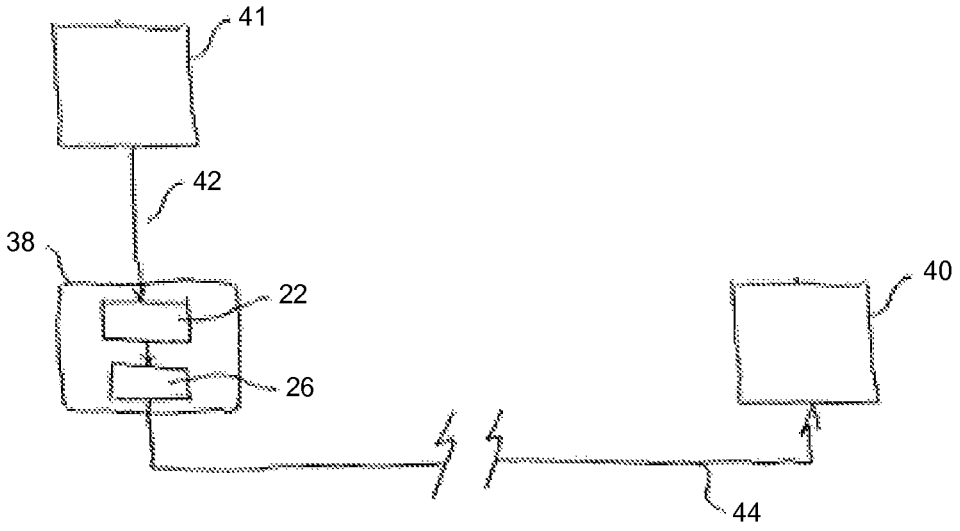
FIG. 4 is a simplified schematic of a system in accordance with an aspect of the present invention.

Finally, FIG. 4 illustrates one exemplary system according to the present invention. The hydrogen donator stream is produced at a first refinery 41 and transported to the production site 38 via a pipeline 42. The production site 38 comprises the blender unit 22 and the reactor 26. As described above, the blender 22 mixes the hydrogen donator and the bitumen and outputs them as a mixture to the reactor 26, where the mixture is subjected to elevated temperatures enabling the partial hydrocracking reaction. The product is then pumped through a pipeline 44 to a second refinery 40, and the partially upgraded bitumen product (including the spent hydrogen donator) is then processed as desired at the second refinery 40.

While the blender and the reactor have been illustrated as separate vessels for the sake of clarity, it will be clear to those skilled in the art that they could be combined into a single vessel.

There are thus numerous advantages inherent in one or more embodiments of the present invention. For example, as would be obvious to those skilled in the art, this partial upgrading system can potentially reduce or eliminate the diluent usage for shipping the bitumen in pipeline. With the help of the hydrogen donator, the amount of coke and cracked gas formation can be minimized, which prevents hydrocarbon lost. With the presence of the hydrogen donator, hydrotreating reactions could occur during this partial upgrading process, which may lower impurities in the bitumen such as sulfur, nitrogen and metals such as nickel and vanadium, aiding in downstream processing. The partial upgrading may also reduce the total acid number (TAN) by the hydrogen donator hydrotreating naphthenic acids present in the heavy hydrocarbon and thus potentially reducing pipeline and refinery corrosion. By eliminating the need for diluent, there is a consequent pipeline volume reduction. Also, there is no catalyst usage, and no diluent is required as pipeline specifications have been otherwise achieved. Further, no on-site hydrogen plant is required due to the integration of indirect hydrogen addition.

As will be clear from the above, those skilled in the art would be readily able to determine obvious variants capable of providing the described functionality, and all such variants and functional equivalents are intended to fall within the scope of the present invention. For example, it will be obvious to those skilled in the art that the blender and reactor could in some embodiments be the same piece of equipment with a plural functionality.

Unless the context clearly requires otherwise, throughout the description and the "comprise", "comprising", and the like are to be construed in an inclusive sense, as opposed to an exclusive or exhaustive sense; that is to say, in the sense of "including, but not limited to".

"connected", "coupled", or any variant thereof, means any connection or coupling, either direct or indirect, between two or more elements; the coupling or connection between the elements can be physical, logical, or a combination thereof.

"herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and systems have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

What is claimed is:

1. A system for partially upgrading a produced heavy hydrocarbon, produced at a well pad, for transport to a refinery via a pipeline, the system comprising:

a first source for supplying the heavy hydrocarbon;

a second source for supplying a hydrogen donator;

a first vessel, at a location between the well pad and the refinery or at a location adjacent the well pad, for blending the heavy hydrocarbon and the hydrogen donator to form a mixture, the first vessel operating at a temperature of 25 to 500 degrees Celsius, at a pressure of 100 to 3500 psi, and a residence time of 1 minute to 5 hours; and a second vessel for heating the mixture in the absence of a catalyst, at the location between the well pad and the refinery, to a temperature necessary to liberate hydrogen molecules from the hydrogen donator and allow the hydrogen molecules to bond with the heavy hydrocarbon, resulting in a partially hydrogenated heavy hydrocarbon for transport to the pipeline;

wherein the second vessel operates at a temperature of 300 to 500 degrees Celsius, at a pressure of 100 to 3500 psi, and a residence time of 15 seconds to 2 hours.

2. The system of claim 1 further comprising cooling means for cooling the partially hydrogenated heavy hydrocarbon.

3. The system of claim 1 wherein the heavy hydrocarbon has a viscosity above pipeline specifications and the partially hydrogenated heavy hydrocarbon has a viscosity within the pipeline specifications.

4. The system of claim 1 wherein the heavy hydrocarbon is bitumen.

5. The system of claim 1 wherein the hydrogen donator is prepared from a material that has the ability to take up hydrogen in a hydrocracking zone and to readily release it to a hydrogen-deficient heavy hydrocarbon under thermal conditions in the absence of a catalyst.

6. The system of claim 1 wherein the hydrogen donator is an aromatic-naphthenic material.

7. The system of claim 1 wherein the hydrogen donator is an aromatic-naphthenic material produced through partial hydrogenation of poly-aromatic molecules.

8. The system of claim 7 wherein the poly-aromatic molecules are naphthalene or anthracene.

9. The system of claim 6 wherein the aromatic-naphthenic material is tetralin.

10. The system of claim 6 wherein the aromatic-naphthenic material is a substituted tetralin.

11. The system of claim 1 wherein the second source for supplying a hydrogen donator is a synthetic crude oil.

12. The system of claim 1 wherein the second source for supplying a hydrogen donator is a fraction from a synthetic crude oil.

13. The system of claim 12 wherein the fraction from the synthetic crude oil is kerosene, diesel or gas oil.

14. The system of claim 1 wherein the first vessel for blending the heavy hydrocarbon and the hydrogen donator is a blending apparatus.

15. The system of claim 14 wherein the blending apparatus is a surge drum.

16. The system of claim 1 wherein the second vessel for heating the mixture is a heater or a liquid-phase reactor-type vessel.

17. The system of claim 16 wherein the heater is a convectional heater.

18. The system of claim 1 further comprising transporting means for transporting the heavy hydrocarbon to the first vessel for blending the heavy hydrocarbon and the hydrogen donator.

19. The system of claim 18 wherein the transporting means for transporting the heavy hydrocarbon comprises a pre-heater for reducing the viscosity of the heavy hydrocarbon.

20. The system of claim 2 wherein the cooling means for cooling the partially hydrogenated heavy hydrocarbon comprise a heat exchange system.

21. The system of claim 1 further comprising transporting means for transporting the partially hydrogenated heavy hydrocarbon to the pipeline.

22. The system of claim 1 wherein the second vessel for heating the mixture produces gas.

23. The system of claim 22 further comprising means for treating the gas.

24. The system of claim 23 wherein the means for treating the gas comprises a sulphur recovery unit.

25. The system of claim 19 further comprising cooling means for cooling the partially hydrogenated heavy hydrocarbon;

wherein the cooling means for cooling the partially hydrogenated heavy hydrocarbon comprises a heat exchange system; and wherein heat captured by the heat exchange system is transferred to the pre-heater via heat transferring means.

26. A method for partially upgrading a produced heavy hydrocarbon, produced at a well pad, for transport to a refinery via a pipeline, the method comprising the steps of:

supplying the heavy hydrocarbon;

supplying a hydrogen donator;

blending the heavy hydrocarbon and the hydrogen donator, wherein said blending is conducted in a first vessel and at a location between the well pad and the refinery or at a location adjacent the well pad, to form a mixture, the step of blending occurs at a temperature of 25 to 500 degrees Celsius, at a pressure of 100 to 3500 psi, and a residence time of 1 minute to 5 hours; and heating the mixture in the absence of catalyst, wherein said heating is conducted in a second vessel and at the location between the well pad and the refinery, to a temperature necessary to liberate hydrogen molecules from the hydrogen donator and allow the hydrogen molecules to bond with the heavy hydrocarbon, thereby producing a partially hydrogenated heavy hydrocarbon;

wherein the step of heating the mixture occurs at a temperature of 300 to 500 degrees Celsius, at a pressure of 100 to 3500 psi, and a residence time of 15 seconds to 2 hours.

27. The method of claim 26 further comprising the step of cooling the partially hydrogenated heavy hydrocarbon.

28. The method of claim 26 wherein the heavy hydrocarbon has a viscosity above pipeline specifications and the partially hydrogenated heavy hydrocarbon has a viscosity within the pipeline specifications.

29. The method of claim 26 wherein the heavy hydrocarbon is bitumen.

30. The method of claim 26 wherein the hydrogen donator is prepared from a material that has the ability to take up hydrogen in a hydrocracking zone and to readily release it to a hydrogen-deficient heavy hydrocarbon under thermal conditions in the absence of a catalyst.

31. The method of claim 26 wherein the hydrogen donator is an aromatic-naphthenic material.

32. The method of claim 26 wherein the hydrogen donator is an aromatic-naphthenic material produced through partial hydrogenation of poly-aromatic molecules.

33. The method of claim 32 wherein the poly-aromatic molecules are naphthalene or anthracene.

34. The method of claim 31 wherein the aromatic-naphthenic material is tetralin.

35. The method of claim 31 wherein the aromatic-naphthenic material is a substituted tetralin.

36. The method of claim 26 wherein the step of supplying the hydrogen donator comprises supplying the hydrogen donator from a synthetic crude oil.

37. The method of claim 26 wherein the step of supplying the hydrogen donator comprises supplying the hydrogen donator from a fraction from a synthetic crude oil.

38. The method of claim 37 wherein the fraction from the synthetic crude oil is kerosene, diesel or gas oil.

39. The method of claim 26 wherein the first vessel is a blending apparatus.

40. The method of claim 39 wherein the blending apparatus is a surge drum.

41. The method of claim 26 wherein the second vessel is a heater or a liquid-phase reactor-type vessel.

42. The method of claim 41 wherein the heater is a convectional heater.

43. The method of claim 26 further comprising the step of transporting the heavy hydrocarbon to the first vessel for the step of blending the heavy hydrocarbon and the hydrogen donator.

44. The method of claim 43 wherein the step of transporting the heavy hydrocarbon comprises pre-heating the heavy hydrocarbon for reducing viscosity of the heavy hydrocarbon.

45. The method of claim 27 wherein the step of cooling the partially hydrogenated heavy hydrocarbon comprises:

heat exchanging to remove heat from the partially hydrogenated heavy hydrocarbon; and capturing the heat by a heat capture system.

46. The method of claim 26 further comprising transporting the partially hydrogenated heavy hydrocarbon to the pipeline.

47. The method of claim 26 further comprising producing gas in the second vessel.

48. The method of claim 47 further comprising treating the gas.

49. The method of claim 48 wherein the step of treating the gas comprises removing sulphur from the gas.

50. The method of claim 44 further comprising cooling the partially hydrogenated heavy hydrocarbon, wherein the step of cooling the partially hydrogenated heavy hydrocarbon comprises heat exchanging to remove heat from the partially hydrogenated heavy hydrocarbon;

capturing the heat by a heat capture system; and transferring the heat via heat transferring means to preheat the heavy hydrocarbon.

51. The system of claim 1 wherein the first vessel for blending the heavy hydrocarbon and the hydrogen donator comprises a plurality of vessels in series.

52. The system of claim 1 wherein the second vessel for heating the mixture comprises a plurality of vessels in series.

53. The method of claim 26 wherein the step of blending the heavy hydrocarbon and the hydrogen donator occurs in the first vessel comprising a plurality of vessels in series.

54. The method of claim 26 wherein the step of heating the mixture occurs in the second vessel comprising a plurality of vessels in series.

* * * * *